US005313512A

United States Patent [19]

Tanaka

[11] Patent Number: 5,313,512

[45] Date of Patent: May 17, 1994

[54] X-RAY TUBE DEVICE WITH DETACHABLE HEAT EXCHANGER

[75] Inventor: Shigeru Tanaka, Tochigi, Japan

[73] Assignee: Kabushiki Kaisha Toshiba, Kawasaki, Japan

[21] Appl. No.: 37,667

[22] Filed: Mar. 24, 1993

Related U.S. Application Data

[63] Continuation of Ser. No. 666,718, Mar. 8, 1991, abandoned.

[30] Foreign Application Priority Data

Mar. 8, 1990 [JP] Japan ..... 2-059097

[51] Int. Cl.[5] ..... H01J 35/10

[52] U.S. Cl. ..... 378/200; 378/202

[58] Field of Search ..... 378/200, 202, 199, 201

[56] References Cited

U.S. PATENT DOCUMENTS 2,049,275 7/1936 Simon ..... 378/200

2,457,961 1/1949 Wehmer ..... 378/200

4,780,901 10/1988 Gabbay et al. ..... 378/200

*Primary Examiner*—Craig E. Church

*Attorney, Agent, or Firm*—Oblon, Spivak, McClelland, Maier & Neustadt

[57] ABSTRACT

An X-ray tube device capable of reducing an amount of work required in the operation of its replacement, and of eliminating a wasteful replacement of a still operational part of the device. The device includes an X-ray tube; at least one heat exchanger for cooling the X-ray tube by using a circulation of insulating oil; a plurality of oil hoses for transmitting the insulating oil between the X-ray tube and the heat exchanger; and at least one coupler for connecting the X-ray tube and the heat exchanger through the oil hoses by being in a coupled state, and for disconnecting the X-ray tube and the heat exchanger through the oil hoses by being in a decoupled state.

10 Claims, 5 Drawing Sheets

X-RAY TUBE DEVICE WITH DETACHABLE HEAT EXCHANGER

This application is a continuation of application Ser. No. 07/666,718, filed on Mar. 8, 1991, now abandoned.

BACKGROUND OF THE INVENTION

1. Field of the Invention

The present invention relates to an X-ray tube device including an X-ray tube and a heat exchanger for cooling the X-ray tube.

2. Description of the Background Art

A medical apparatus using X-ray such as an X-ray diagnostic apparatus and an X-ray computed tomography apparatus has an X-ray tube device as shown in FIG. 1, where an X-ray tube 101 is equipped with a heat exchanger 102 which is connected with the X-ray tube 101 through oil hoses 103, so as to cool down the X-ray tube 101 by forcefully circulating the insulating oil through the X-ray tube 101, oil hoses 103 and the heat exchanger 102.

Conventionally, these X-ray tube 101 and the heat exchanger 102 have been manufactured as a unified element, undetachably from each other, and the weight of this unified element tended to become heavier as the need of the X-ray tube 101 of a larger capacity increases. For example, the weight of the X-ray tube 101 is typically about 50 Kg, while the weight of the heat exchanger 102 is also typically about 50 Kg.

Now, there is a need for replacing the X-ray tube 101 regularly, because of a limit life time of the X-ray tube 101. In a case of replacing the old X-ray tube by the new one, because the X-ray tube 101 is manufactured to be undetachable from the heat exchanger 102, the entire X-ray tube device as a whole has to be replaced, even when the heat exchanger 102 is still operational. In a case of the example described above, this implies that the entire element weighing almost 100 Kg has to be replaced, which in turn requires several workers in this operation of replacement.

Thus, the conventional X-ray tube device has been associated with the problems that the operation of replacement requires a large number of workers because of its heavy weight, and that the entire X-ray tube device has to be replaced even when either the heat exchanger or the X-ray tube alone is needed to be replaced, so that it has been not quite economical.

SUMMARY OF THE INVENTION

It is therefore an object of the present invention to provide an X-ray tube device capable of reducing an amount of work required in the operation of its replacement, and of eliminating a wasteful replacement of a still operational part of the device.

According to one aspect of the present invention there is provided an X-ray tube device, comprising: an X-ray tube; at least one heat exchanger means for cooling the X-ray tube by using a circulation of insulating oil; a plurality of oil hoses for transmitting the insulating oil between the X-ray tube and the heat exchanger means; and at least one coupler means for connecting the X-ray tube and the heat exchanger means through the oil hoses by being in a coupled state, and for disconnecting the X-ray tube and the heat exchanger means through the oil hoses by being in a decoupled state.

According to another aspect of the present invention there is provided an X-ray tube device, comprising: an X-ray tube; at least one heat exchanger means for cooling the X-ray tube by using a circulation of coolant fluid; a plurality of coolant hoses for transmitting the coolant fluid between the X-ray tube and the heat exchanger means; and at least one coupler means for connecting the X-ray tube and the heat exchanger means through the coolant hoses by being in a coupled state, and for disconnecting the X-ray tube and the heat exchanger means through the coolant hoses by being in a decoupled state.

Other features and advantages of the present invention will become apparent from the following description taken in conjunction with the accompanying drawings.

DETAILED DESCRIPTION OF THE PREFERRED EMBODIMENTS

Figure 1:
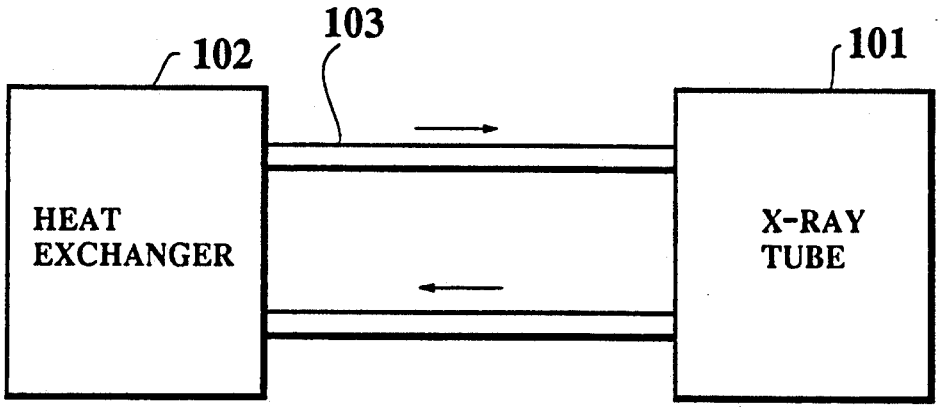
FIG.1 PRIOR ART
FIG. 1 is a schematic block diagram of a conventional X-ray tube device.
Figure 2:
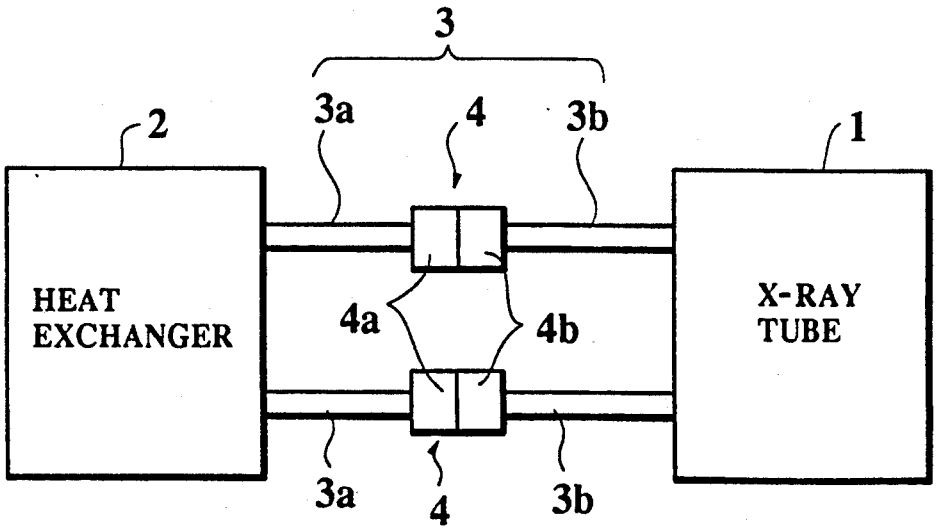
FIG. 2 is a schematic block diagram of one embodiment of an X-ray tube device according to the present invention.

Referring now to FIG. 2, one embodiment of an X-ray tube device according to the present invention will be described in detail.

This X-ray tube device of FIG. 2 comprises an X-ray tube 1; a heat exchanger 2 for cooling the X-ray tube; a pair of oil hoses 3 connecting the X-ray tube 1 and the heat exchanger 2, one for sending the insulating oil from the heat exchanger 2 to the X-ray tube 1 and the other for returning the insulating oil from the X-ray tube 1 to the heat exchanger 2, where each one of the oil hoses 3 is divided into a heat exchanger side **3*a* and an X-ray tube side 3*b*; and two couplers 4 each of which detachably couples the heat exchanger side 3*a* and the X-ray tube side 3*b* of one of the oil hoses 3, where each one of the couplers 4 is divided into a socket 4*a* and a plug 4*b* which is inserted into the socket 4*a* in forming a joint by the coupler 4**.

In this X-ray tube device, the X-ray tube 1 is cooled forcefully by the circulation of the insulating oil through the X-ray tube 1, oil hoses 3 coupled by the couplers 4, and the heat exchanger 2.

Each of the couplers 4 preferably is a so called push-pull type which can be coupled and decoupled by a single action, and which also has a configuration for effectively preventing oil leakage as well as air mixing. An example of a commercially available coupler that can be used for these couplers 4 is a type 350 coupler manufactured and sold by Nitto Kohki Co. Ltd. of Tokyo, Japan.

Figure 3:
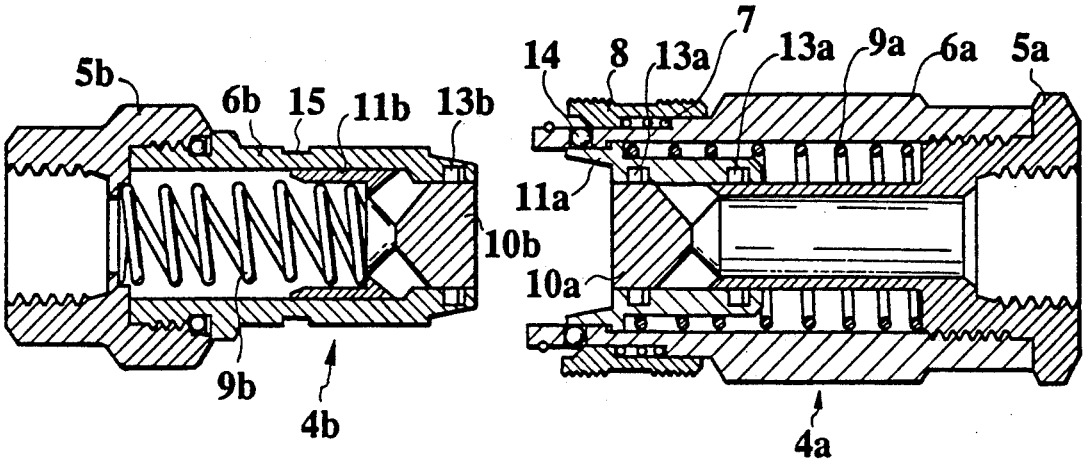
FIG. 3 is a cross sectional view of a coupler used in the X-ray tube device of FIG. 2, in a decoupled state.
Figure 4:
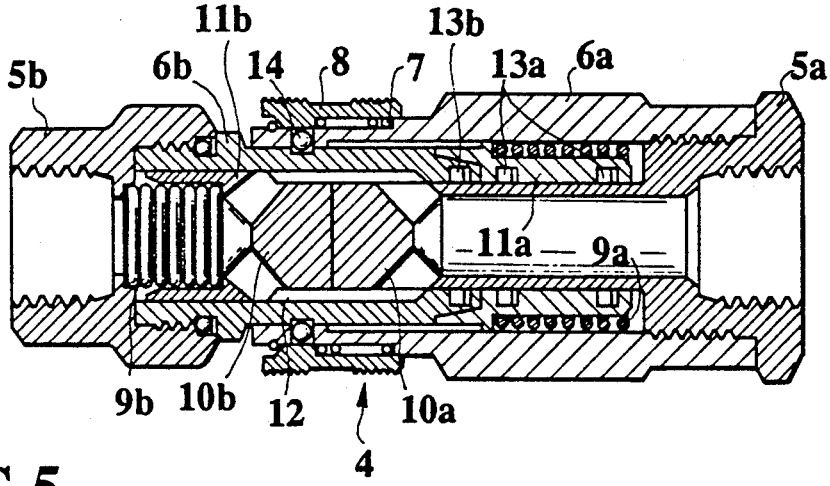
FIG. 4 is a cross sectional view of a coupler used in the X-ray tube device of FIG. 2, in a coupled state.

An exemplary configuration for such a coupler 4 is shown in FIG. 3 in a decoupled state, and in FIG. 4 in a coupled state.

As shown in FIG. 3, the socket 4*a* of the coupler 4 comprises a hollow adapter 5*a* for receiving an end of the oil hose 3; a hollow cylindrical body 6*a* attached to the adapter 5*a* having a ball lock mechanism 14 near a coupling end of the body 6*a*; a spring coil 7 placed around the coupling end of the body 6*a* on an outer side of the body 6*a*, with one end abutted against a hedge on the body 6*a*; a sleeve 8 slidable along the outer side of the body 6*a* around the coupling end of the body 6*a*, having a hedge against which another end of the spring coil 7 is abutted, and which can be slid manually over to the ball lock mechanism in the coupled state; a fixed valve 10*a* located at the coupling end of the body 6*a*; a spring coil 9*a* placed inside the hollow of the body 6*a* with one end abutted against the edge of the adaptor 5*a*; an inner slide 11*a* having a hedge against which another end of the spring coil 9*a* is abutted and seal members 13*a*, which can be slid along an inner wall of the body 6*a*, and which is located around the valve 10*a* in the decoupled state so as to close off the coupling end of the body 6*a* in conjunction with the valve 10*a*.

On the other hand, the plug 4*b* of the coupler 4 comprises a hollow adapter 5*b* for receiving an end of the oil hose 3; a hollow cylindrical body 6*b* attached to the adapter 5*b* having indents 15 for receiving the ball lock mechanism 14 of the socket 4*a* in the coupled state and a seal member 13*b* near the coupling end of the body 6*b*; a spring coil 9*b* placed inside the hollow of the body 6*b* with one end abutted against the edge of the adaptor 5*b*; a movable valve 10*b* connected with an inner slide 11*b* having a hedge against which another end of the spring coil 9*b* is abutted, both of which can be slid along an inner wall of the body 6*b* such that when the body 6*b* pushes the inner slide 11*a* of the socket 4*a* in the coupled state the valves 11*a* and 11*b* meet each other and a passage 12 is formed around the valves 11*a* and 11*b*.

Thus, in forming a joint by coupling the socket 4*a* and the plug 4*b*, the plug 4*b* is inserted into the socket 4*a* with the sleeve 8 slid off the ball lock mechanism 14, such that the coupling end of the body 6*b* pushes the inner slide 11*a* of the socket 4*a* until the ball lock mechanism 14 is caught by the indents 15 of the plug 4*b*, in which state the valves 11*a* and 11*b* meet each other and the passage 12 is formed around the valves 11*a* and 11*b*. The sleeve 8 is then slid over to the ball lock mechanism 14 in order to lock the coupling of the socket 4*a* and the plug 4*b*, as shown in FIG. 4.

On the contrary, in decoupling the coupler 4, the sleeve 8 is slid off the ball lock mechanism 14, and then the plug 4*b* is pulled out from the socket 4*a*.

Figure 5:
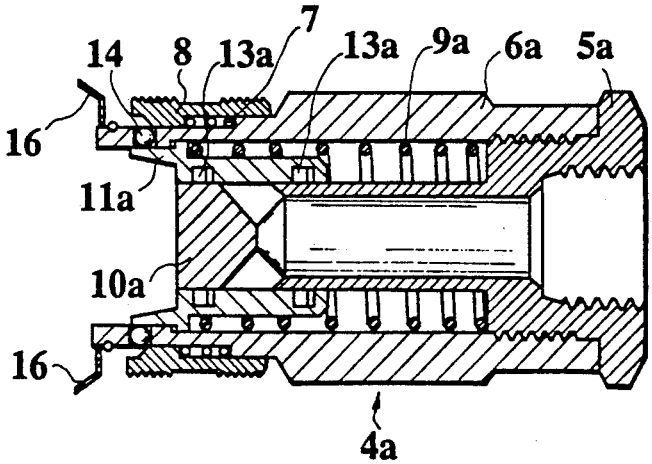
FIG. 5 is a cross sectional view of one variation of a socket of a coupler of FIGS. 3 and 4.

The coupler 4 having such a configuration has a significant reduction of the air mixing compared with couplers of other configurations, which is more crucial for the coupler 4 than is the reduction of the oil leakage. In order to improve the reduction of the air mixing further, the socket 4*a* of the coupler 4 may additionally be equipped, as shown in FIG. 5, with an oil pan 16 at the coupling end of the body 6*a* which is to be filled with insulating oil before the plug 4*b* is to be inserted into the socket 4*a*.

In this embodiment, because the X-ray tube 1 and the heat exchanger 2 can be detached from each other by decoupling the couplers 4, so that in a case of replacement, only one of the X-ray tube 1 and the heat exchanger 2 can be replaced without touching the other one of the X-ray tube 1 and the heat exchanger 2.

Consequently, not only can a wasteful replacement of the still operational part be eliminated, but also the amount of work required in the operation of the replacement can be reduced because the workers need to deal only with one of the X-ray tube 1 and the heat exchanger 2. In practice, the number of workers for this operation can be reduced to about two workers in the X-ray tube device of this embodiment, in contrast to several workers required conventionally.

Moreover, because the couplers 4 can be of the so called push-pull type which can be coupled and decoupled at a single action, they are therefore very easy to handle in the operation of the replacement.

Figure 6:
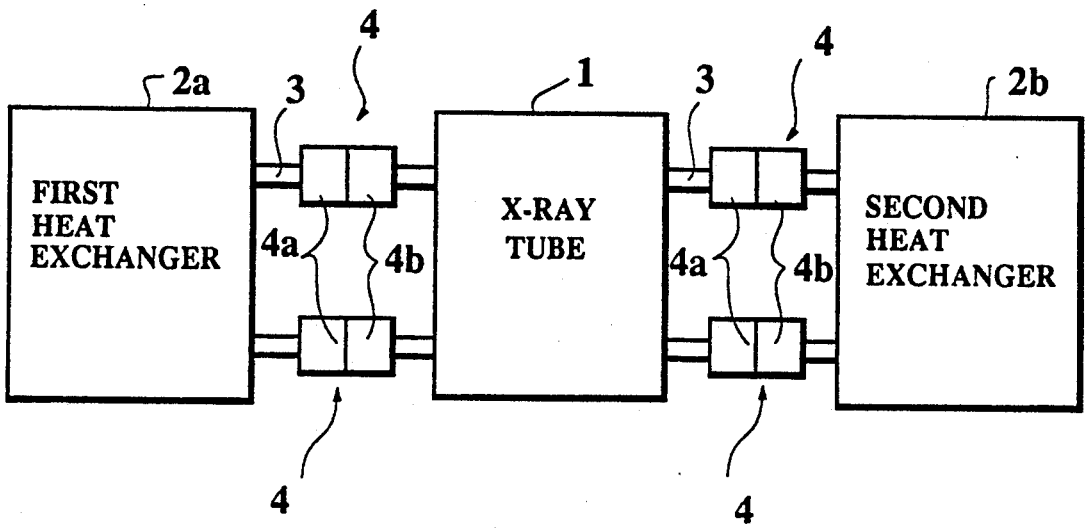
FIG. 6 is a schematic block diagram of one variation for the embodiment of an X-ray tube device of FIG. 2.

Referring now to FIG. 6, one variation of the above embodiment will be described.

In this variation of FIG. 6, two heat exchangers 2*a* and 2*b* are connected on the left and right of the X-ray tube 1 through the oil hoses 3 incorporating the couplers 4 as in the above described embodiment.

Figure 7:
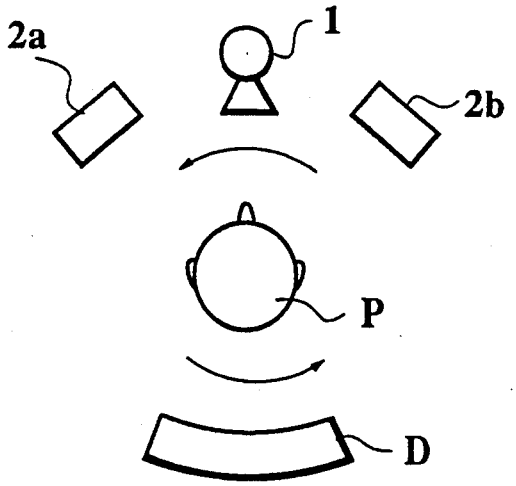
FIG. 7 is a schematic block diagram of an X-ray computed tomography apparatus incorporating the variation of FIG. 6.

Such a configuration is preferable in the X-ray computed tomography apparatus in which, as shown in FIG. 7, the X-ray tube 1 is to be rotated around the patient P along with the heat exchangers 2*a* and 2*b* and the detector D located on an opposite side from the X-ray tube device, because the improved balance can be achieved in the rotation operation.

Figure 8:
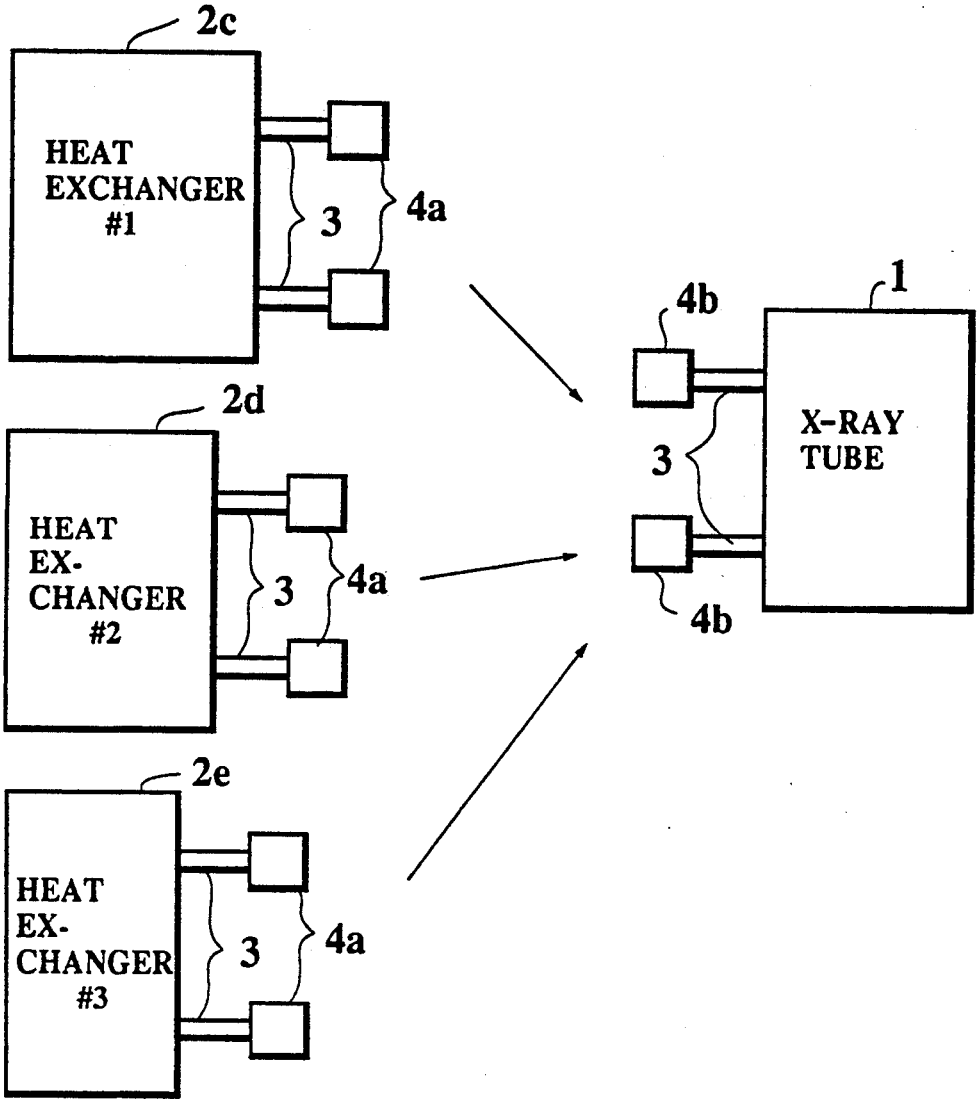
FIG. 8 is a schematic block diagram of another variation for the embodiment of an X-ray tube device of FIG. 2.

Referring now to FIG. 8, another variation of the above embodiment will be described.

In this variation of FIG. 8, a plurality (three in the figure) of heat exchangers 2*c*, 2*d* and 2*e*, each of which has a different capacity, are provided for the X-ray tube 1, such that an appropriate one of the heat exchangers 2*c*, 2*d* and 2*e* can be connected with the X-ray tube 1 according to the particularity of the situation in which the X-ray tube device is to be operated.

Figure 9:
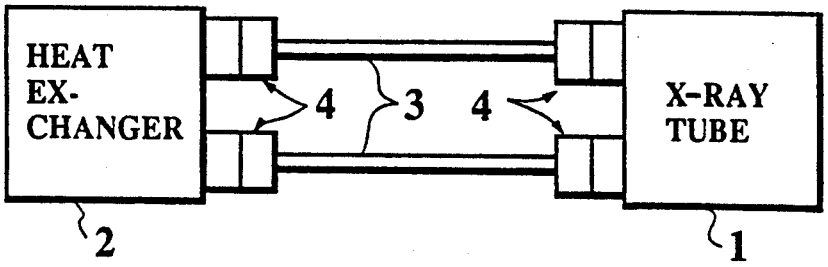
FIG. 9 is a schematic block diagram of another variation for the embodiment of an X-ray tube device of FIG. 2.

It may be more convenient to further modify the configuration of FIG. 8 by utilizing a configuration shown in FIG. 9, where altogether four couplers 4 are used, in which one of the socket 4*a* and the plug 4*b* of each coupler 4 is directly attached to the X-ray tube 1 and the heat exchanger 2, while another one of the socket 4*a* and the plug 4*b* of each coupler is attached to one end of one of the oil hoses 3. Such a configuration may be easier to handle, so that the changing of the heat exchanger to be connected with the X-ray tube from one heat exchanger to another may become easier.

Figure 10:
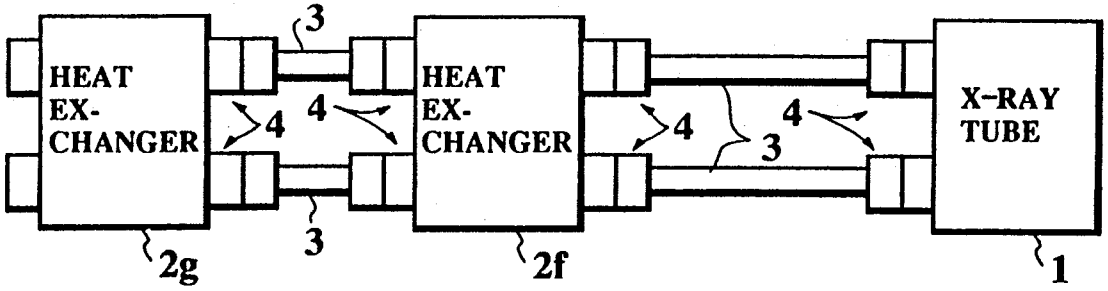
FIG. 10 is a schematic block diagram of another variation for the embodiment of an X-ray tube device of FIG. 2.
Figure 11:
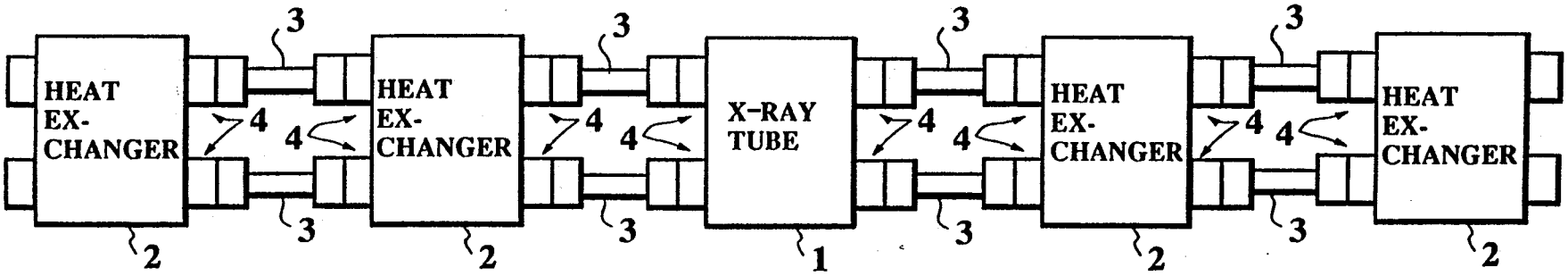
FIG. 11 is a schematic block diagram of another variation for the embodiment of an X-ray tube device of FIG. 2.

Also, instead of changing the heat exchanger to be connected with the X-ray tube 1 among a plurality of different heat exchangers as in FIG. 8, a number of heat exchangers may be provided and a number of heat exchangers to be connected with the X-ray tube 1 simultaneously may be changed, as shown in FIG. 10 where a number of heat exchangers 2*f*, 2*g*, and so on are provided, each of which has four couplers 4 on both sides, and adjacent heat exchangers are connected through the oil hoses 3.

It should be obvious that it may also be possible to utilize other configurations such as that shown in FIG.

11 which is a hybrid of the variations shown in FIGS. 6, 9, and 10.

It is also to be noted that although the above embodiment has been described as using insulating oil for the coolant, other fluids such as water may also be used for the coolant.

Besides these, many modifications and variations of the above embodiments may be made without departing from the novel and advantageous features of the present invention. Accordingly, all such modifications and variations are intended to be included within the scope of the appended claims.

What is claimed is:

1. An X-ray tube device, comprising:

an X-ray tube;

at least one heat exchanger means for cooling the X-ray tube by using a circulation of insulating oil;

a plurality of oil hoses for transmitting the insulating oil between the X-ray tube and the heat exchanger means; and at least one coupler means for connecting the X-ray tube and the heat exchanger means through the oil hoses by being in a coupled state, and for disconnecting the X-ray tube and the heat exchanger means through the oil hoses by being in a decoupled state, each coupler means having one coupling end equipped with an oil pan to be filled with the insulating oil at a time of forming the coupled state with another coupling end.

2. The X-ray tube device of the claim 1, wherein one of the coupler means is incorporated in a middle of each oil hose.

3. the X-ray tube device of the claim 1, wherein one of the coupler means is incorporated between the X-ray tube and each oil hose and between the heat exchanger and each oil hose.

4. The X-ray tube device of the claim 1, wherein a plurality of the heat exchanger means are connected symmetrically to two opposite sides of the X-ray tube.

5. The X-ray device of the claim 1, wherein a plurality of the heat exchanger means are connected in series.

6. The X-ray tube device of the claim 1, wherein each of the coupler means is a push-pull type which can be coupled and decoupled by a single action.

7. The X-ray tube device of the claim 1, wherein each of the coupler means has a reduced amount of air mixing in the coupled state.

8. The X-ray tube device of the claim 1, wherein each of the coupler means has a reduced amount of oil leakage in the coupled state.

9. An X-ray tube device, comprising:

an X-ray tube;

at least one heat exchanger means for cooling the X-ray tube by using a circulation of coolant fluid;

a plurality of coolant hoses for transmitting the coolant fluid between the X-ray tube and the heat exchanger means; and at least one coupler means for connecting the X-ray tube and the heat exchanger means through the coolant hoses by being in a coupled state, and for disconnecting the X-ray tube and the heat exchanger means through the coolant hoses by being in a decoupled state, each coupler means having one coupling end equipped with a coolant pan to be filled with the coolant fluid at a time of forming the coupled state with another coupling end.

10. The X-ray tube device of the claim 9, the coolant fluid is water.

* * * * *